United States Patent [19]

Bruinsma et al.

[11] Patent Number: 4,532,789

[45] Date of Patent: Aug. 6, 1985

[54] PROCESS FOR REDUCING THE WIDTH OF A FLAT METAL PRODUCT BY ROLLING

[75] Inventors: Hans Bruinsma, Uitgeest; Frans Hollander, Castricum; Rein L. Huisman; Adrianus G. Reinen, both of Beverwijk, all of Netherlands

[73] Assignee: Estel Hoogovens B.V., Ijmuiden, Netherlands

[21] Appl. No.: 506,583

[22] Filed: Jun. 22, 1983

Related U.S. Application Data

[63] Continuation of Ser. No. 238,965, Feb. 27, 1981, abandoned.

[30] Foreign Application Priority Data

Feb. 28, 1980 [NL] Netherlands ..... 8001197

[51] Int. Cl.[3] ..... B21B 27/06

[52] U.S. Cl. ..... 72/202; 72/205; 72/234; 72/235

[58] Field of Search ..... 72/199, 202, 226, 234, 72/235, 365, 366, 205

[56] References Cited

U.S. PATENT DOCUMENTS

| | | | |
|---|---|---|---|
| 3,358,358 | 12/1967 | Jenks et al. | 72/205 |
| 3,757,556 | 9/1973 | Kawawa et al. | 72/234 |
| 4,067,220 | 1/1978 | Hoffmann | 72/202 |
| 4,089,196 | 5/1978 | Kondo et al. | 72/205 |

*Primary Examiner*—Lowell A. Larson
*Assistant Examiner*—Jorji M. Griffin
*Attorney, Agent, or Firm*—Stevens, Davis, Miller & Mosher

[57] ABSTRACT

To reduce the width of slabs from a reheating furnace to the width required in a finishing rolling train, thereby making it possible to feed slabs of only one width, or only a few widths, into the reheating furnace, the invention proposes rolling the slab in a width-reducing roll train in which the slab is subjected to traction such that plastic deformation occurs between the roll sets. In particular the width-reducing roll train has only one set of thickness rolls and has one or more sets of width rolls, thereby minimizing the length of the roll train and consequently reducing the lengths at the ends of the slab which are not subjected to the traction.

14 Claims, 5 Drawing Figures

PROCESS FOR REDUCING THE WIDTH OF A FLAT METAL PRODUCT BY ROLLING

This is a continuation of Ser. No. 238,965, filed Feb. 27, 1981, abandoned July 28, 1983.

BACKGROUND OF THE INVENTION

1. Field of the Invention

The present invention relates to a process for reducing the width of a flat metal product by rolling wherein the product is passed through at least one roll train having width rolls and thickness rolls. In another aspect the invention relates to a process of hot rolling steel strip from a slab.

2. Description of the Prior Art

Very large quantities of steel strip are produced at the present time, for use in the manufacture of consumer goods, especially motor vehicles. This strip is conventionally hot rolled from slabs to the desired thickness in a finishing rolling train containing a large number of roll stands at which thickness is reduced but width is substantially not altered. Since different customers have different demands for the width of the strip which they buy, it is a major problem in operating such a roll train (which is a highly expensive plant and has a very large throughput capacity) to arrange the feeding of hot slabs of the desired widths in the desired order to the beginning of the roll train. Such slabs come from several sources: (a) slabs from continuous casting machines (the continuously produced strand must be cut before being supplied to the roll train because the output rate of a single continuous casting machine is very much lower than the capacity of the roll train), (b) slabs from a slabbing mill in which cast ingots are rolled into slabs and (c) cold slabs brought in form storage or from an outside source of supply.

All such slabs are passed through a reheating furnace prior to entering the finishing rolling train, in order to bring them to the desired temperature and to ensure that they are at uniform temperature all through their volume. Hitherto, slabs have generally been cold when supplied to the reheating furnace, which makes the arrangement of the slabs in the desired order fairly easy. However, with a view to saving energy, it is nowadays highly desirable that slabs from a continuous casting machine or from a slabbing mill should pass directly into the reheating furnace with the minimum of delay. It is not convenient to control in detail the width of the slabs produced in a slabbing mill in dependence on the width requirements for the finishing rolling train.

Also, it is highly impractical to shut down a continuous casting machine frequently in order to change the width of the slabs which it produces. An appreciation of this problem in a continuous casting machine is shown in U.S. Pat. No. 3,358,358 which is dated 1967 i.e. before high energy costs became a serious problem. This patent proposes that the continuous strand produced is reduced to the various desired widths by edge rolling of the strand while longitudinal tension is applied to the strand between spaced horizontal roll stands. The purpose of application of longitudinal tension is to reduce the tendency towards a "dog-bone" cross sectional shape which has hitherto arisen during edge rolling (in the "dog-bone" shape the outer portions of the rectangular section are considerably thicker than the middle portion).

Specifically, U.S. Pat. No. 3,358,358 proposes the use of a special width reducing roll train which has two horizontal roll stands (i.e. thickness roll stands) which apply the longitudinal tension, and a plurality of width roll stands located between the two thickness roll stands. This process is designed for use with a strand which has been produced by continuous casting and the width rolling occurs immediately after temperature equalization has been carried out in a furnace. The object of the process is to use the substantial width reduction that can be obtained when width rolling is carried out under high traction forces, in order to enable a continuous casting machine to produce slabs of desired width (less than the actual casting width) without the need for changing the casting mould or for cutting the continuous casting into discrete slabs and then reducing their width by rolling them by conventional methods before finishing.

However, the process suffers from a number of disadvantages in practice. Firstly, as it is performed continuously after the casting process, each continuous casting machine used will require an individual width reducing roll train. Secondly it is nowadays desirable in practice that the substantial width reduction in the high traction width reducing roll train is followed by a finishing roll train. As mentioned, the capacity of a finishing roll train is far greater than the production capacity of a continuous casting machine and thus for optimum operation a plurality of continuous casting machines are required to supply the finishing roll train. The product must therefore be cut before entering the finishing roll train unless a plurality of finishing roll trains are used which would be very expensive and uneconomic. However the width reducing roll train of U.S. Pat. No. 3,358,358 cannot be used economically with discontinuous slabs, because the full traction force is not exerted on the head and tail of the slab as it passes through the width reducing roll train. This results in a large quality variation in the slab at its ends. The length of the width-reducing roll train is so great (as mentioned above) that the resultant waste in each slab would be such as to render its use with slab highly uneconomic. Therefore the process is apparently suitable only to be operated continuously so that an individual width reducing roll train is required for each continuous casting machine, which is expensive. Furthermore the intermediate produced rolled can only be obtained by continuous casting. The disadvantages of this process are therefore such that it is not thought to have been used other than experimentally.

SUMMARY OF THE INVENTION

The object of the present invention is to provide a process in which a substantial reduction can be made in the width of discrete lengths of intermediate product from one or more of a variety of sources by the use of a single process giving a high material yield.

Another object of the invention is to provide a method of rolling slabs into steel strip in which the problem discussed above arising from the need to supply the slabs to the reheating furnace in a predetermined order is avoided.

The invention achieves these objects by providing a process of reducing the width of a flat metal product by rolling in a roll train in which a high traction force is applied to the product (as in U.S. Pat. No. 3,358,358). The new process is characterized in that the metal product is a discrete slab and in that the roll train has only one set of thickness rolls (horizontal rolls) and has, upstream of the thickness rolls in the rolling direction, at least one set of flat width rolls. Flat width rolls are width rolls which present a vertical smooth surface to each side of the flat metal product.

Since only one set of thickness rolls is present, the roll train can be exceedingly short, so avoiding the problem of loss of quality at the ends of the slab which are not subjected to the traction force in the roll train. It should be remembered that the distance in the rolling direction occupied by a thickness roll stand is much greater than that occupied by a width roll stand because the thickness rolls must be much larger than the width rolls, on account of the larger dimension of the slab which must be spanned by the thickness rolls. In its simplest form, the roll train proposed by the invention can consist of a single thickness roll stand and a single width roll stand. Such a roll train is relatively cheap.

In another aspect, the invention achieves the second object specified above by providing a process of hot rolling of steel strip wherein a slab is heated in a reheating furnace and is rolled in a finishing train having a plurality of roll stands in which the width of the slab is not substantially altered. This process is characterized in that between the reheating furnace and the finishing rolling train, the slab is rolled to the desired width in a width reducing roll train having both width rolls and thickness rolls and in which a traction force is applied to the slab between the first and last roll sets of the width reducing roll train so that plastic deformation of the slab occurs between the sets of rolls.

The advantage achieved by this process is very considerable. As in U.S. Pat. No. 3,358,358 a width reduction roll train is employed which minimizes the tendency to the "dog-bone" shape, but now this roll train has been put to use in a situation in which it produces real and significant benefits, in particular that the slabs can be fed into the reheating furnace in an order which takes no regard, or much less regard than hitherto, of their width, because the adjustment of width occurs after the reheating furnace and before entry to the finishing rolling train. This means that in many cases hot slabs can be fed into the reheating furnace immediately from the slabbing mill or, after cutting of the strand, immediately from a continuous casting machine. The resultant energy savings are very considerable. The process, of course, does not exclude the use of cold slabs from outside sources.

A further advantage over U.S. Pat. No. 3,358,358 is that the continuous casting (if used) and width rolling processes are separate and are therefore independent of each other. The overall process is consequently less susceptible to breakdowns in either part.

It should be noted that in U.S. Pat. No. 3,757,556 is also proposed to achieve a substantially plastic reduction in the width of an intermediate product with the aid of a roll train which includes one stand of width rolls and one stand of thickness rolls; however, grooved rolls are used in place of flat width rolls. In addition, a high traction force is not applied between these grooved rolls and the thickness rolls.

The width reduction achieved by the present invention may if desired be increased even further by the addition of a further set of width reducing rolls downstream of the set of thickness rolls.

In the case of a particularly large reduction in the width of an intermediate product, the so-called angle of bite may be too large for immediate width rolling and as a result the product cannot be fed into the roll train. It is then advisable to include, in at least one of the roll trains for width rolling, an extra stand of width rolls upstream of the first stand of width rolls. Such width rolls will achieve some width reduction so as to allow the product to enter the rest of the roll train and will also help spread the load of width reduction.

It has been found that the maximum reduction possible per pass in a single roll train (while retaining an acceptable cross sectional shape) is preferably that given by the formula:

$$(B_o - B_u)_{max} = H_o V$$

where $B_o$ = the width of the intermediate product at entry into the roll train, $B_u$ = the width of the intermediate product at exit from the roll train, $H_o$ = the thickness of the intermediate product at entry into the roll train, V = a shape factor with a maximum value of about 3 for a value of $B_o/H_o$ of about 10.

Although described above in relation to steel, the process can be applied to various materials, even to metal which can be rolled cold.

As already discussed above, additional advantages may be obtained if the metal product is rolled to width by the process of the invention between a reheating furnace and a finishing rolling train. This will now be discussed further. In particular, it is proposed that this width reduction is performed in a roughing down train of a hot strip mill in which one or more trains for width rolling are fitted between a scale breaker and the finishing train.

In known hot strip mills, one or more roughing down stands equipped with smooth edging rolls are used. The purpose of these edging rolls is to reduce the width of the metal product so as to correct for the spread which occurs in the rolled material during thickness rolling and to smooth the edges of the rolled material. In known hot strip mills the possible width reduction is generally limited to a maximum of 50–100 mm. No high traction force is applied. The consequence of this procedure is that the width of the product to be made must be substantially reached before the hot strip mill. However, if the product is manufactured by continuous casting, it is difficult to produce different widths because adjustment of the mould in a continuous casting plant is a time-consuming operation which results in loss of production. In a slabbing mill for producing steel slabs, the modern procedure is to roll the slabs to different widths, increasing in steps of, e.g. 50 mm or less, depending on the hot strip mill which follows. However, this necessitates a wide variety of ingot types and ingot mould types.

An advantage of the process in which the product is rolled to width in the roughing down train of a hot strip mill is that a smaller number of different slab widths has to be supplied to the hot strip mill. In a practical example, the widths of the products manufactured in a hot strip mill, i.e. hot rolled coils, varies between 800 and 2000 mm. With the process proposed and an initial slab thickness of, say, 200 mm, these products can be manufactured from plates of 3 different widths, for example, 2000, 1600 and 1200 mm. This means less adjustment of moulds in continuous casting and fewer ingot types and ingot mould types in the slabbing mill. This has the additional advantage that smaller stocks are required for cold insertion into the slab reheating furnaces of the hot strip mill both in terms of absolute quantities and in terms of the range of widths, thus reducing the intermediate storage. Moreover because a wider intermediate product can be supplied by the continuous casting plant and slabbing mill for a given rolled product width, better use is made of the capacity of these plants. Finally, when taken together, the advantage described can result in shorter throughput times and in a more continuous flow of material.

A particular complication encountered in a hot strip mill plant is that the slabs have to be rolled in a certain width sequence (the so-called "kite" model) because of the wear of the rolls in the finishing train during a campaign. This places high requirements on the logistics of feeding the slabs into the slab-reheating furnaces of the hot strip mill. Now that the hot strip products can be manufactured from slabs with a limited number, e.g. three of standard widths, feeding them in is much simpler in that slabs of the same width can be supplied to the hot strip mill over a much longer period. This also makes it easier to deliver the slabs warm to the hot strip mill immediately after manufacture and roll them. It may, of course, be necessary to bring them to a uniform temperature or to heat them up.

The width rolling in the width reducing roll train can be done either as a continuous process or in a plurality of passes using a reversible roll train. It is preferable that the width rolling takes place in a number of passes, so that rolling can be done to the precise width required. Alternatively, however width rolling the product may be passed through one or more roll trains once in one direction only.

BRIEF INTRODUCTION OF THE DRAWINGS

Preferred embodiments of the invention will now be described by way of example with reference to the accompanying drawings, in which.

Figure 1:
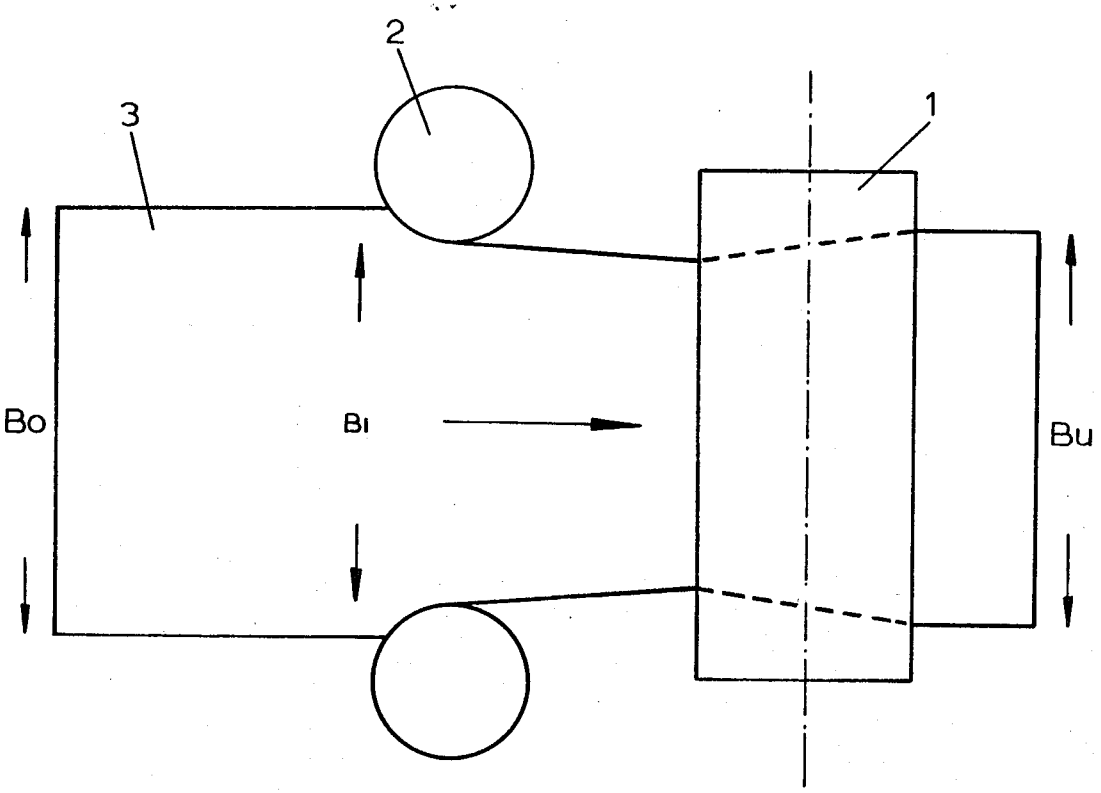
FIG. 1 is a schematic plan view showing the principle of a roll train for rolling a metal product to width in accordance with the invention.

FIG. 1 shows a width reducing roll train having a stand 1 of thickness rolls and a stand 2 of width rolls. The flat material 3 to be rolled is introduced into the roll train with a width $B_o$ and drawn by the thickness rolls 1 through the width rolls 2, which are set to a width $B_l$. In this process the width is plastically reduced to an exit width of $B_u$. What happens in the mill is unusually complicated. A high traction force exists in the metal between the two roll stands. The edges of the material are thickened when it passes through the width rolls 2 thus forming a cross section resembling a "dog-bone" shape. The thickened edges are removed by displacement in the thickness direction when the material passes through the thickness rolls 1 and this results in a slight spreading in the width of the slab from $B_l$ to $B_u$, i.e. plastic deformation occurs due to the traction force applied. The high traction force (or tensional force) between the width and thickness rolls has the result that the rolled material has a better cross sectional shape after the thickness rolling than it would otherwise have.

Tests were carried out in a scaled down test set-up using plasticine obtained from Talens B.V. in Apeldoorn, Holland as the test material. The behaviour of this material at room temperature (20° C.) is very similar to that of hot metals undergoing plastic deformation e.g. steel at 1250° C. The tests were carried out in a room with a constant temperature of 20° C.

Figure 2:
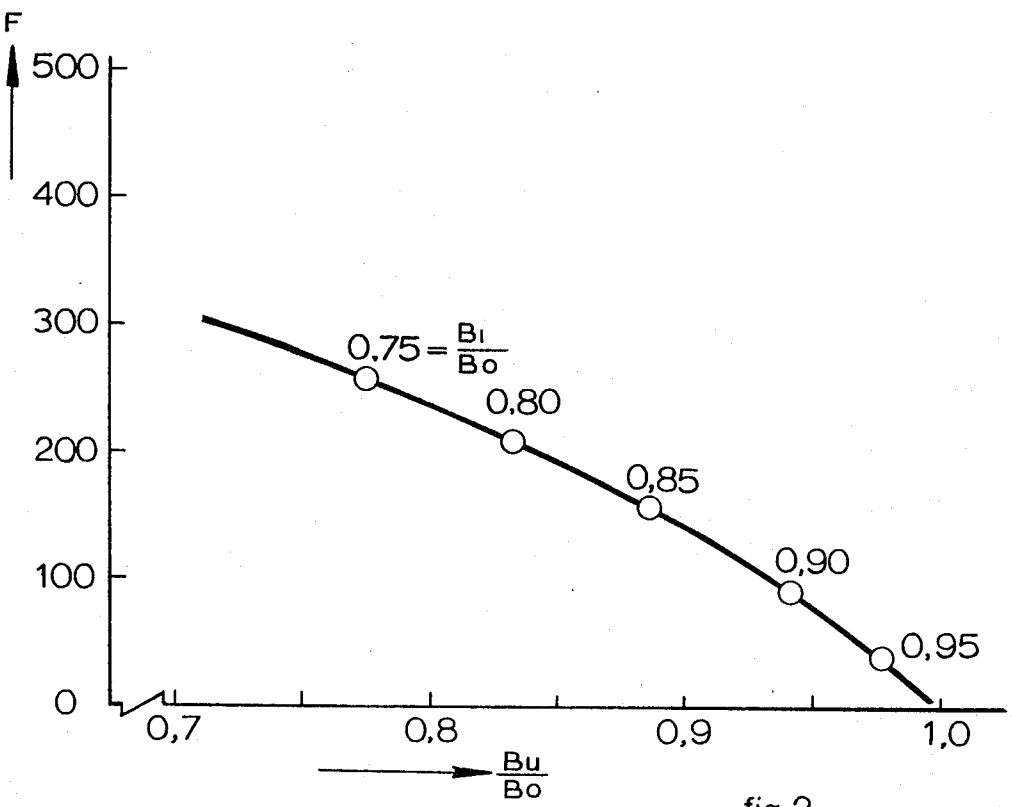
FIG. 2 is a graph of the results obtained with a test set-up based on the principle shown in FIG. 1.

The graph in FIG. 2 shows characteristic results obtained in these tests with rolling material having an entry width $B_o$ of 200 mm and an entry thickness $H_o$ of 22 mm with free-running, non-driven width rolls. The ratio of the exit width $B_u$ to the entry width $B_o$ of the material is plotted along the horizontal axis, while the vertical axis represents the traction force F between the width and thickness rolls expressed in Newtons. Along the curve the appropriate values of the ratio of the width setting $B_l$ of the width rolls to the entry width $B_o$ have been inserted. It is evident from the graph that a substantial width reduction is achievable with the dimensions of the rolling material already quoted. Moreover, the cross-sectional shape after rolling is acceptable.

A substantial width reduction can similarly be achieved in a steel slab at 1250° C. with an entry width $B_o$ of 2000 mm and an entry thickness $H_o$ of 200 mm. It can be calculated from the physical properties of steel and plasticine that the horizontal traction force required in such a slab would be about 20,000 times larger than that required in the plasticine.

The stress produced in the material as a result of the high traction force between the width and thickness rolls in the case of large width reductions is of the same order of magnitude as the yield point of the material.

If the width rolls are driven, the width reduction achieved is approximately the same. Driving these rolls is of importance not so much from the point of view of the maximum width reduction which can be achieved as for feeding the material into the roll train.

Figure 3:
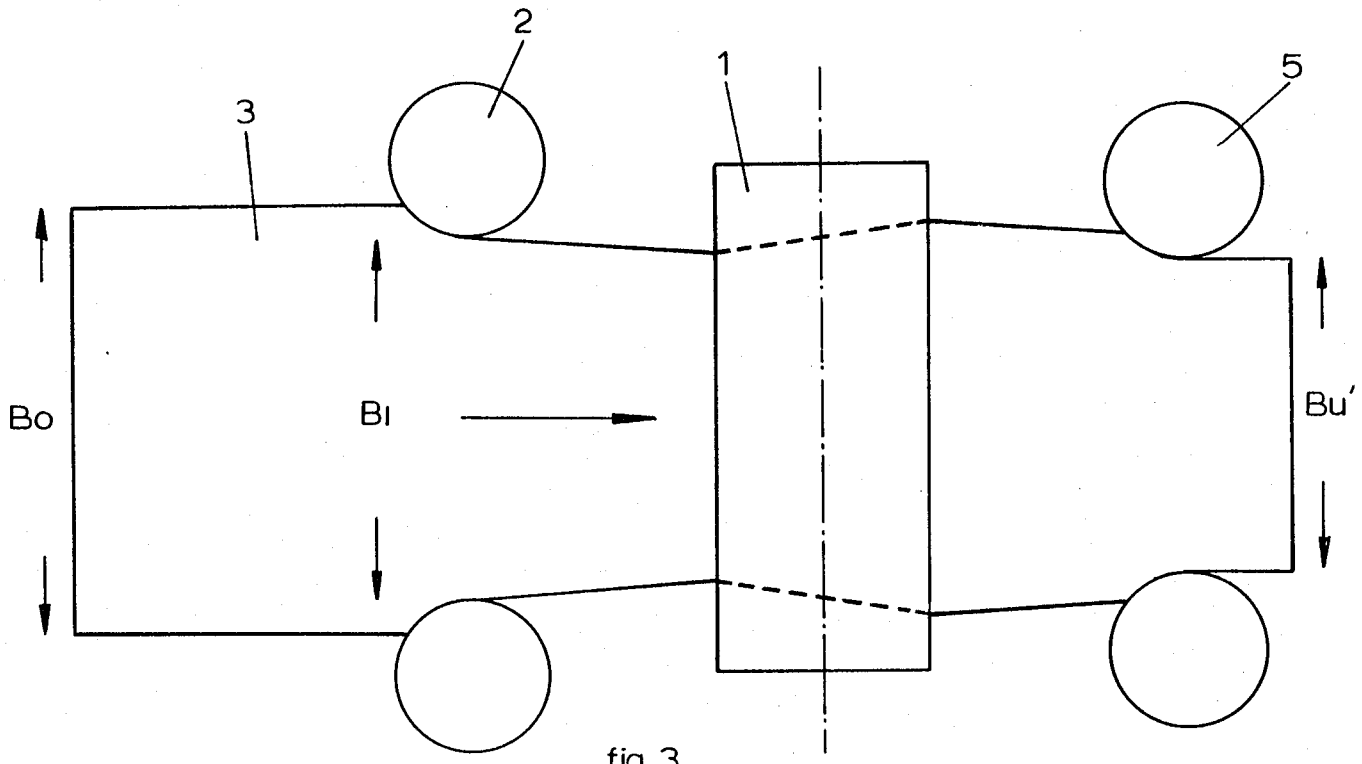
FIG. 3 is a plan view showing the principle of a train of rolls as in FIG. 1 with a set of width rolls after the thickness rolls.

A still greater width reduction can be obtained in a roll train arrangement as shown in FIG. 3. In this arrangement the rolling stock after leaving the thickness rolls 1 is rolled by a set of driven width rolls 5, whereby the width is further reduced to the exit width $B_u'$. When the stock being rolled passes through the width rolls 5 the edges of the material are thickened thus forming a cross sectional shape resembling a dog bone. Because of the traction force that is applied to the stock between the driven width rolls 5 and the thickness rolls 1, the cross sectional form of the stock after the width rolls 5 is far better than without the traction force.

This particular roll train arrangement is of particular importance in the case as with for example steel, where the coefficient of friction between the rolling stock and the rolls is small. The width reduction in such cases is limited by the slippage of the rolls. Under these circumstances width reduction is performed in a number of passes. With the rolling arrangement of FIG. 3 the stock will after the width rolls 5 have a slight dog bone cross section but this will be flattened during the next pass by the thickness rolls. With this arrangement the number of passes can thus be limited.

Figure 4:
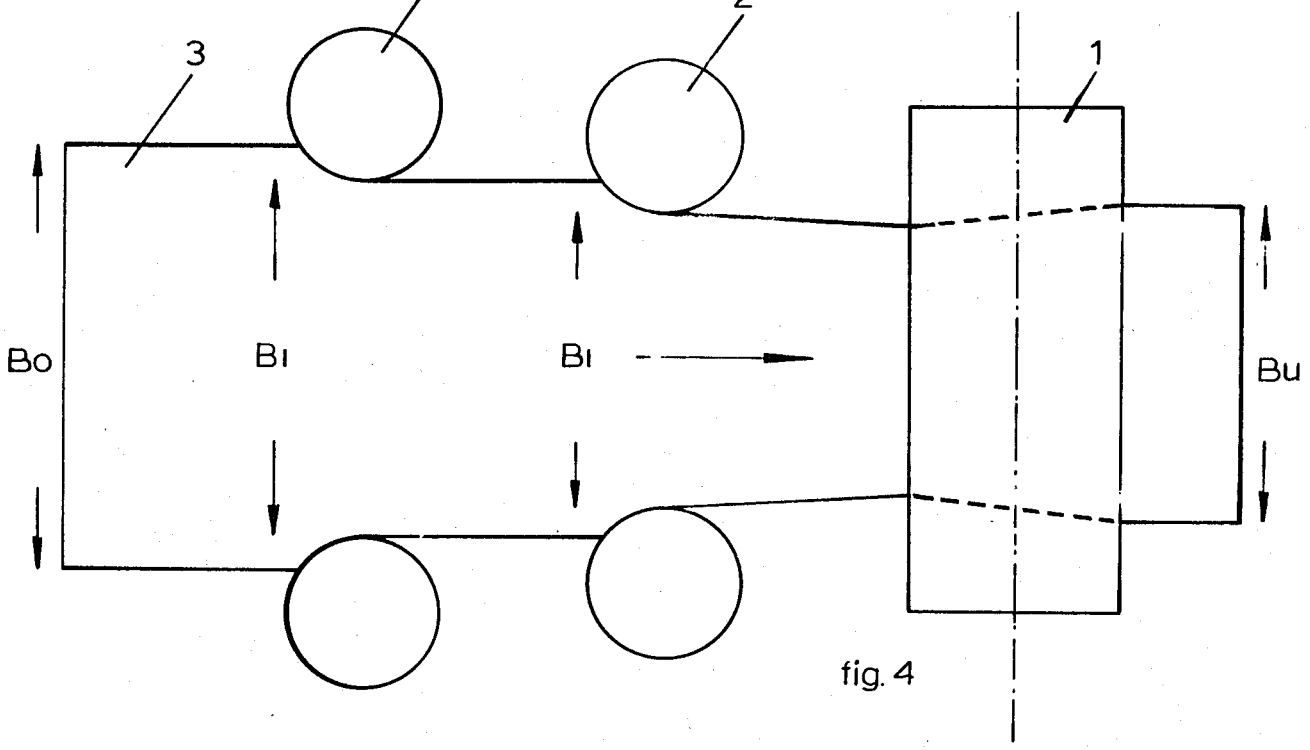
FIG. 4 is a plan view showing the principle of a roll train as in FIG. 1 but with an additional stand of width rolls before the thickness rolls.

For large width reductions in the roll train of FIG. 1, the width setting $B_l$ may be so much smaller than the entry thickness $B_o$ that the bite angle is too large for the thickness rolls and the material cannot be fed into the roll train. In this event a roll train as shown in FIG. 4 is to be preferred; in this there is an extra stand of rolls 4 in front of the first stand 2. Approximately the same width reductions can be achieved with the roll train in FIG. 4 as with that in FIG. 1, ie from $B_o$ to $B_l'$ to $B_l$. An extra set of width rolls after the thickness rolls 1 can also be used as in the arrangement shown in FIG. 3.

It should be noted that in a practical design the width and thickness rolls are closer together than shown in FIGS. 1, 3 and 4 in order to keep the length of the roll train short, to minimise the length of metal over which there is a width variation at the head and tail.

Further tests were done in plasticine with the test arrangement described above in which the entry width $B_o$ and entry thickness $H_o$ were varied and in which the maximum width reduction achievable was determined. The following results were obtained:

| Entry width $H_o$ | Entry thickness $B_o$ | Max width reduction |
|---|---|---|
| 100 mm | 15 mm | 30 mm |
| 150 mm | 22 mm | 50 mm |
| 200 mm | 22 mm | 60 mm |
| 150 mm | 15 mm | 50 mm |
| 200 mm | 15 mm | 35 mm |

From this it may be concluded that the maximum width reduction per pass is about three times the entry thickness $H_o$ provided the maximum width reduction can be represented by the formula $(B_o - B_u)_{max} = H_o \cdot V$, where V is a shape factor which reaches the above maximum values at a value of $(B_o/H_o)$ of approximately 10.

Figure 5:
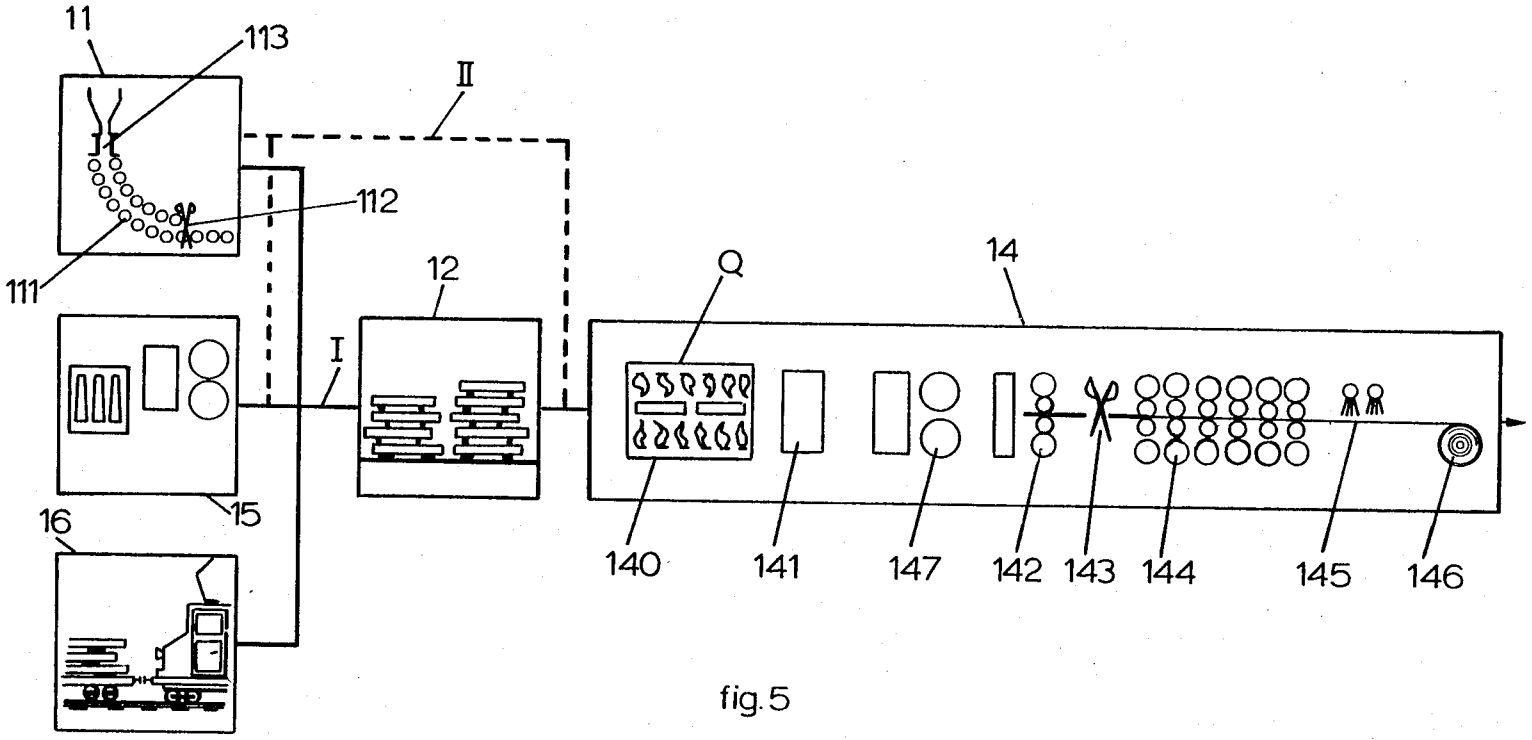
FIG. 5 shows the layout for the process of the invention for rolling to width in a hot strip mill.

FIG. 5 explains the application of the process according to the invention discussed above in a hot strip mill. The conventinal process is as follows. The slabs produced in the continuous casting plant 11 having a casting mould 113, strand support rolls 111 and shears 112, are conveyed by route I to the slab yard 12. They are placed in a slab reheating furnace 140, and, after reaching the required temperature, are rolled in the hot strip mill 14, which contains a scale oxide breaker 141, one or more roughing down stands 142, a shear 143, a finishing train 144, a cooling bed 145 and a coiler 146. The slab yard 12 may also be fed from a slabbing mill 15 or from an outside source 16.

In the roughing down stands 142 the width cannot be reduced by more than 50–100 mm so that the desired width of the hot rolled product must already have been reached in the continuous casting plant 11 or the slabbing mill 15. This necessitates a considerable stock of slabs differing only in width (e.g. increasing in steps of 50 mm).

In accordance with the invention one or more width reducing roll trains 147 as illustrated in FIGS. 1, 3 and 4 which may or may not be reversible, are inserted in the hot strip mill 14, and can be used to reduce the width of the slabs substantially. This allows the range of widths in the slab yard 12 to be reduced to, say, three and offers the prospect of improving the operation of the continuous casting plant 11 (fewer changes needed in the mould 113) and the delivery of ingots to the slabbing mill (fewer types of ingots, fewer types of ingot moulds).

Since, according to the invention, the hot strip mill 14 operates with, say, only three slab widths, it is also easier to convey the slabs made in the continuous casting plant 11 and the slabbing mill 15 directly to the hot strip mill, i.e. along route II. Under these circumstances it is, of course, necessary to bring the slabs to a uniform temperature and even to heat them up a little. This can be done in the slab-reheating furnace 140 (usually a gas or oil fired continuous reheating furnace) in which case the heat Q supplied in the route II is much less than for route I.

What is claimed is:

1. A process of reducing the width of a flat metal product by rolling, comprising drawing the product in the form of a discrete slab through at least one width-reducing roll train having at least one set of flat width rolls and only one set of thickness rolls, applying a sufficiently high traction force to the product between a set of width rolls upstream of said set of thickness rolls and said set of thickness rolls that plastic deformation of the product occurs.

2. The process according to claim 1 including passing said slab between one set of flat width rolls downstream of the said one set of thickness rolls.

3. The process according to claim 1 or claim 2 including drawing said slab between two sets of flat width rolls upstream of said one set of thickness rolls.

4. The process according to claim 1 including drawing said slab between two sets of flat width rolls upstream of said one set of thickness rolls and passing said slab between one set of flat width rolls downstream of the said one set of thickness rolls.

5. The process according to claim 1 wherein the metal product is a steel slab.

6. The process according to claim 5 including heating the slab in a reheating furnace and rolling the slab in a finishing train of a hot strip mill after the width-reducing roll train acts on the slab.

7. The process according to claim 6 including producing the slab in a continuous casting machine or a slabbing mill, and transporting said slab while still hot into said reheating furnace.

8. The process according to claim 1 including subjecting said slab to width reduction a plurality of times by passing said slab a plurality of times through said width-reducing roll train.

9. The process according to claim 1, wherein the metal product is passed once only through each of one or more of said width-reducing roll trains.

10. In a process of hot rolling steel strip from a slab comprising heating the slab in a reheating furnace and thereafter rolling the hot slab into a strip in a finishing train having a plurality of roll stands in which the width of the slab is not substantially altered, the improvement comprising heating the slab in the reheating furnace, rolling the slab in a width-reducing roll train having at least one set of flat width rolls and only one set of thickness rolls and applying a traction force to the slab between a set of width rolls upstream of said thickness rolls and said thickness rolls so that plastic deformation of the slab occurs between the sets of rolls in the width-reducing roll train prior to rolling in said finishing roll train.

11. The process according to claim 10 including drawing said slab between at least one set of flat width rolls upstream of said set of thickness rolls.

12. The process according to claim 11 including passing said slab between a set of flat width rolls downstream of the said set of thickness rolls.

13. The process according to claim 11 or 12 including drawing said slab between two sets of flat width rolls upstream of the said set of thickness rolls.

14. A process according to one of claims 10 to 12 including producing the slab in a continuous casting machine and transporting said slab while still hot into said reheating furnace.

* * * * *